United States Patent [19]

Lehberger

[11] Patent Number: 4,892,307

[45] Date of Patent: Jan. 9, 1990

[54] BALANCING STICK TOY

[76] Inventor: Arthur N. Lehberger, 256 Winfield Ter., Union, N.J. 07083

[21] Appl. No.: 322,344

[22] Filed: Mar. 13, 1989

[51] Int. Cl.[4] ..... A63F 9/00

[52] U.S. Cl. ..... 273/1 GF; 273/1 R

[58] Field of Search ..... 273/414, 329, 1 R, 1 GF

[56] References Cited

U.S. PATENT DOCUMENTS 3,955,814 5/1976 Shallenberger ..... 273/1 GF 4,076,238 2/1978 Dively ..... 273/1 GF

FOREIGN PATENT DOCUMENTS 19451 12/1914 Denmark ..... 273/1 GF

*Primary Examiner*—William H. Grieb

*Attorney, Agent, or Firm*—Laforest S. Saulsbury

[57] ABSTRACT

A balancing stick toy in which the stick is pivotally connected to a spindle projecting from the forward end of a handle member on which the stick is to be balanced. With the stick depending from the handle member and the handle member turned, a radially-extending arm on the handle member engages a headed drop latch pin on the stick so as to pick up the stick and turn it to an upright position where under gravity the latch pin drops upon the handle member to release the stick for the balancing exercise with the object being to hold the stick against turning back to the depending position. One player can match his skill against another player.

5 Claims, 2 Drawing Sheets

BALANCING STICK TOY

This invention relates to a balancing stick toy. Heretofore, with balancing stick toys the weighted stick to be balanced is merely placed freely in an upright manner upon the outer end of a handle member while in the hand of the user who then manipulates the handle member to keep the weighted stick balanced in it's vertically-extended state. Any unbalance causes the balancing stick to fall off the end of the handle member to the floor and be damaged or do damage to surrounding things about a room. One who has become skilled, can keep the stick balanced for a long duration but the child novice or beginner will find difficulty in doing so and there will be many unsuccessful trials. In the U.S. Pat. Nos. 3,955,814 and 4,076,238 such prior toys are shown wherein the stick can fall free of the handle member after the attempt having been made to balance the stick from all directions radiating from the vertical. In an early Dansk Patent No. 19,451, the balancing stick is pivotally connected to the outer end of the handle member such as to be sustained in a fore and aft extended verticle plane taken longitudinally through the handle member. With each of these prior toys, there is little need for further skills beyond the straight balancing of the stick upon the outer end of a handle member as with an upturned broom upon an outstretched hand or forefinger. As with the pivot connection of the balancing stick with the handle member of the Dansk patent, the grasp of handle must be firm to keep the balancing stick in a fore and aft vertical plane and balancing the weighted stick is but fore and aft therein. This makes for a different balancing skill than with but the stick resting free upon the handle, as the handle member is only moved fore and aft to balance the stick.

According to the present balancing toy the balancing stick is pivotally connected to the outer end of the handle member and pivots about the axis of the handle member. The stick has a gravity releasable latch pin for engaging a projection arm on the handle to raise, from a depending position to a raised balancing position by turning the handle with the hand. The latch automatically on reaching this position drops and toy user must enter into the balancing of the stick sideways in a vertical plane, lateral and transverse to the axis of the handle member. One must be prompt to take over the balancing n the instant release of the gravity latch thereby adding a new skill to the balancing toy field. Failure to perfect the balancing, the balancing stick just falls over and remains depending from the handle member and ready to be picked up again. Another try will simply be made by turning the handle to lift the balancing stick again to a raised balancing position and automatic release of the latch. To add further difference over prior showings, the weight ball is not rigid with the upper end of the stick but is dependent from a string attached to an overhang top bracket, adding much more to the skill required for the balancing act.

It is the principal object of the present invention to provide a balancing toy wherein the balance stick will be carried by the handle member for free rotation thereon and can be rotated about the handle to its upright balancing position to perform the balancing exercise.

It is another object of the invention to provide a balancing toy in which the balancing stick is normally carried by the handle member for free rotation thereon and releasable means which picks up the balancing stick when depending from the handle member to bring it to an upright balancing position on turning the handle with the hand and automatically release under gravity to free the stick in position to carry out the balancing exercise.

It is still another object of the invention to provide a balancing stick toy in which the weight is connected to swing from the upper end of balancing stick and thereby add to the skill required in the use of the toy.

Further objects of the invention are to provide a balancing stick having the above objects in mind, which is inexpensive to manufacture, has a minimum number of parts, easy to assemble, the stick still separable from the handle member for purposes of storage and transport, of pleasing appearance, enjoyable to use, automatic and efficient in operation.

For a better understanding of the invention, reference may be had to the following detailed description taken in connection with the accompanying drawing, in which FIG. 1 is a perspective view of the present balancing toy with illustration being made of how the user has lifted the balancing stick by the handle member from a depending phantom position to its in use upright position, FIG. 2 is enlarged vertical view of the toy with portions broken away to show more of the assembly of the stick to the handle member, FIG. 3 is a fragmentary transverse sectional view taken on line 3—3 of FIG. 2 and through the gravity drop pin latch, FIG. 4 is a fragmentary vertical sectional view taken on line 4—4 of FIG. 2 and through the pivotal connection of the stick with the spindle of the handle member, FIG. 5 is an enlarged vertical elevational view of a modified form of the invention in which one bracket is used on the stick for connection of the stick to the handle member and for the drop latch that has dropped free of the handle projecting arm and the stick freed upon the handle member for balancing action.

Figure 1:
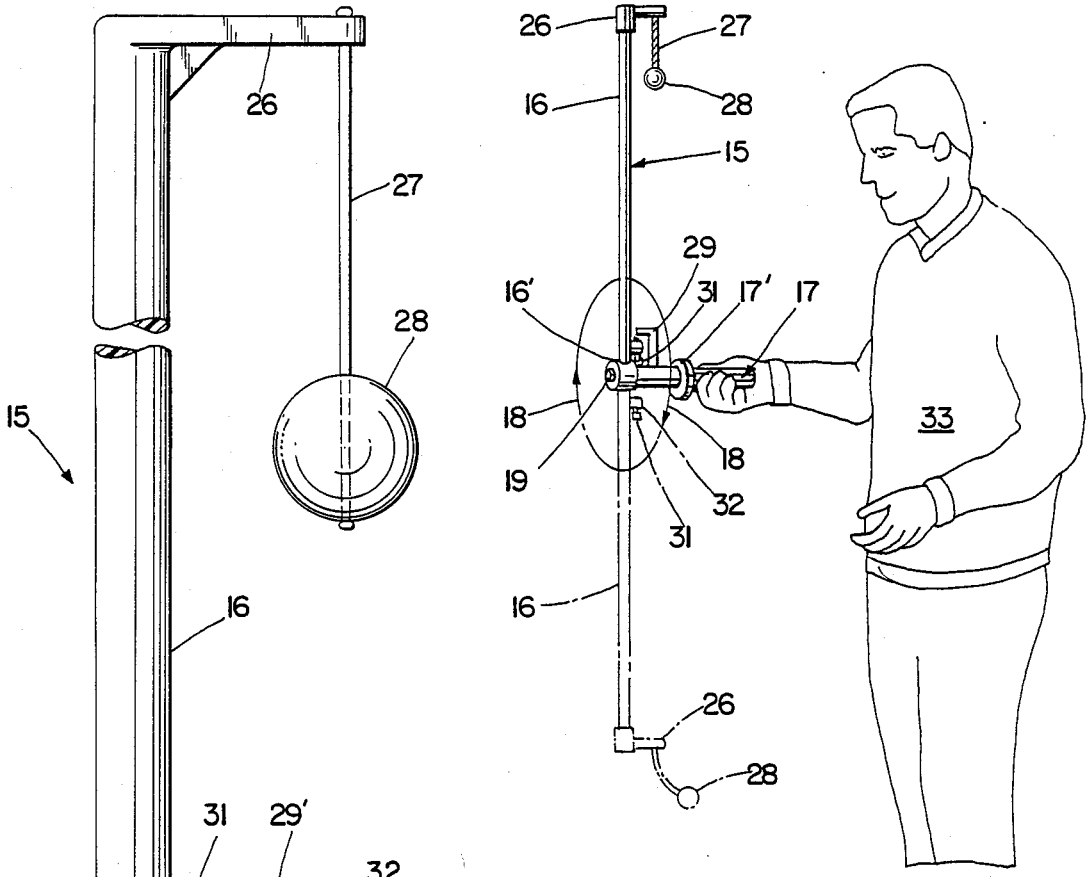

Referring now to the drawing, 15 represents the full balancing toy of the present invention and in FIG. 1 is an illustration of the toy in use by a handler the balancing stick 16 having been raised from a depending phantom position by turning the handle member 17 in the direction of arrows 18. The handle member 17 has an enlarged flange portion 17' intermediate its length to keep the hand from sliding forwardly on the handle member and to protect the user from injury from moving parts on the forward end of the handle member. Extending forwardly of the handle member 17 and secured tightly therein is a pivot shaft or spindle 19 to which the lower end of the balancing stick assembly 16 is pivotally connected for free rotation thereabout. The lower end of the balancing stick 16 is enlarged as indicated at 16' and has a hole therethrough with a light friction sleeve 21 therein and the pivot shaft or spindle 19 on the handle 17 therein. The balancing stick assembly is held against axial displacement between loose washers 22 and 23 and a cotter pin 24.

The upper end of the balancing stick 16 has a laterally extending bracket portion 26 from the outer end of which there is suspended a flexible connection 27 and a swing ball weight 28. Most balancing sticks are weighted by a weight fixed rigidly to the upper end of the stick. With the present weight 28 connected off-set in this manner adds to the skill required for balancing th weighted stick 16.

Extending upwardly from the forward end of the handle member 17 is a radially-extending projection arm 29 with a forwardly bent end 29'against which a drop latch pin 31 is vertically slidable. This drop latch pin 31 is carried in a bracket portion 32 on the lower end of the stick assembly 16 in radial and vertical alignment with top bracket 26 from which the ball weight 28 is suspended. The drop latch pin 31 is headed at 31' to hold the pin against axial displacement from the bracket portion 32 while out of engagement with the bent end 29' of the handle arm projection 29 on the handle member 17. When the latch pin 31 is in the dropped phantom line position 31 of FIG. 2 the stick 16 is free for rotation upon the handle member and the head 31' of the pin will rest upon the peripheral surface of the handle member 17 and thereby be retained against axial displacement from the bracket portion 32 upon the stick free of the bent end 29' of the handle arm and the stick 16 is made free for rotation upon the handle 17 and ready for the balancing exercise. The stick 16 is kept upon the handle member 17 at all times and upon dropping down merely rotates about the pivot shaft or spindle on the handle member 17. The latch pin 31 will drop down in bracket 32 as the stick 16 swings down to the depending position of the arm 29. The bent end 29' engages the side of the pin with its side face when the handle is turned to again lift the stick assembly 16 to its upright balancing position.

In carrying out the balancing exercise, user 33 will start with the stick 16 being lowered in the dotted line position as shown in FIG. 1, and will turn the handle member 17 in direction of arrows 18 until the bent end 29' of the handle arm 29 picks up the lowered pin 31 that is in the bracket 32 on the stick 16 and the stick assembly 16 is brought up to the vertical full line position as shown in FIG. 1.

Figure 2:
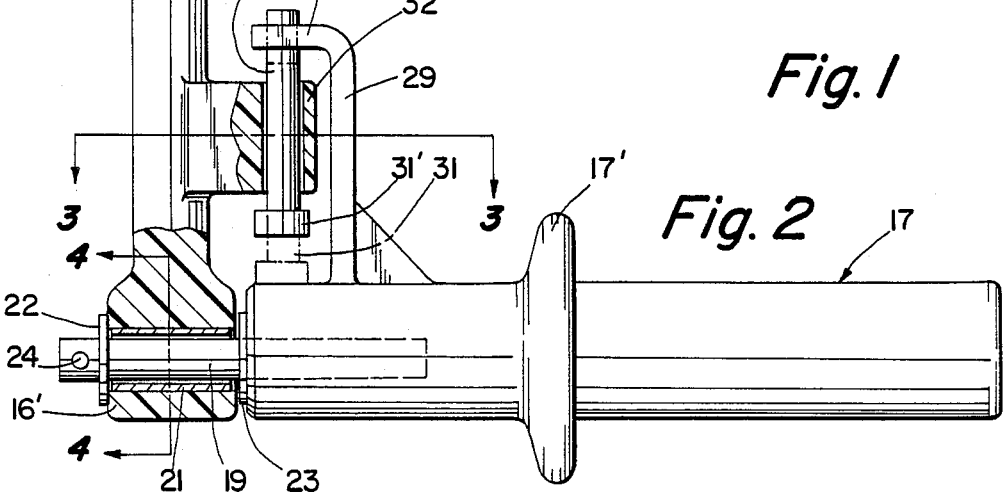
Figure 3:
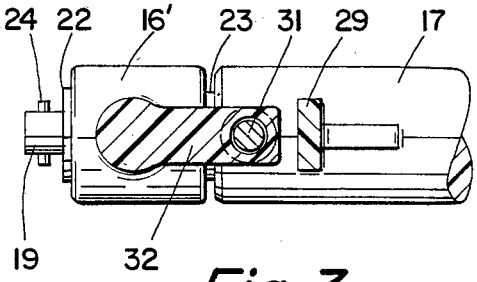
Figure 4:
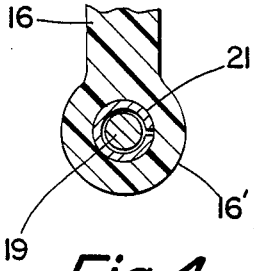

At the instant the stick 16 comes to an exact vertical position the pin 31 will automatically release and drop to the dotted line position as shown in FIG. 2 and the user 33 starts the balancing stunt of laterally moving the bottom of the stick relative to the top of the stick to prevent overbalance and the swinging down of the stick. The weight ball 28 will have to be kept aligned with the stick. When doing the exercise before others scoring may be kept by timing each other's performance.

The split friction sleeve 21 will help some to make the balancing more easy and to some degree lessen the tendency 28 of the stick to fall about the handle but in no way intended to prevent the performance of the exercise. The ball weight suspended from the flexible connection 27 adds also to the amount of skill required to perform the exercise. With much practice, the user will perfect his skill.

In the modified form of the invention shown in FIGS. 5 to 8, the exercise is carried out in precisely the same way as just above described. The only difference over the first form lies in the construction of a stick assembly 36 that is made in two parts for permitting the disassembly of elongated stick 37 from a casting part 38. The one part comprises the plain rod 37 with a top bracket 39 fitted over its upper end and extending laterally to support elongated rod connection 41 and ball weight 44. The casting part 38 has a top opening into which the lower end of the stick part 37 is slid and detachably secured by a thumb screw 45. The lower end of the casting part 38 has a lateral hole for receiving forwardly-extending pivot shaft or spindle 46 of handle member 47 and a friction sleeve 48. The casting part 38 is retained on the shaft 46 between loose washers 51 and 52 and a cotter pin 53. The handle member 47 has a flange portion 47' to keep the hand from sliding forwardly on the handle member.

Figures 5, 6, 7, 8:
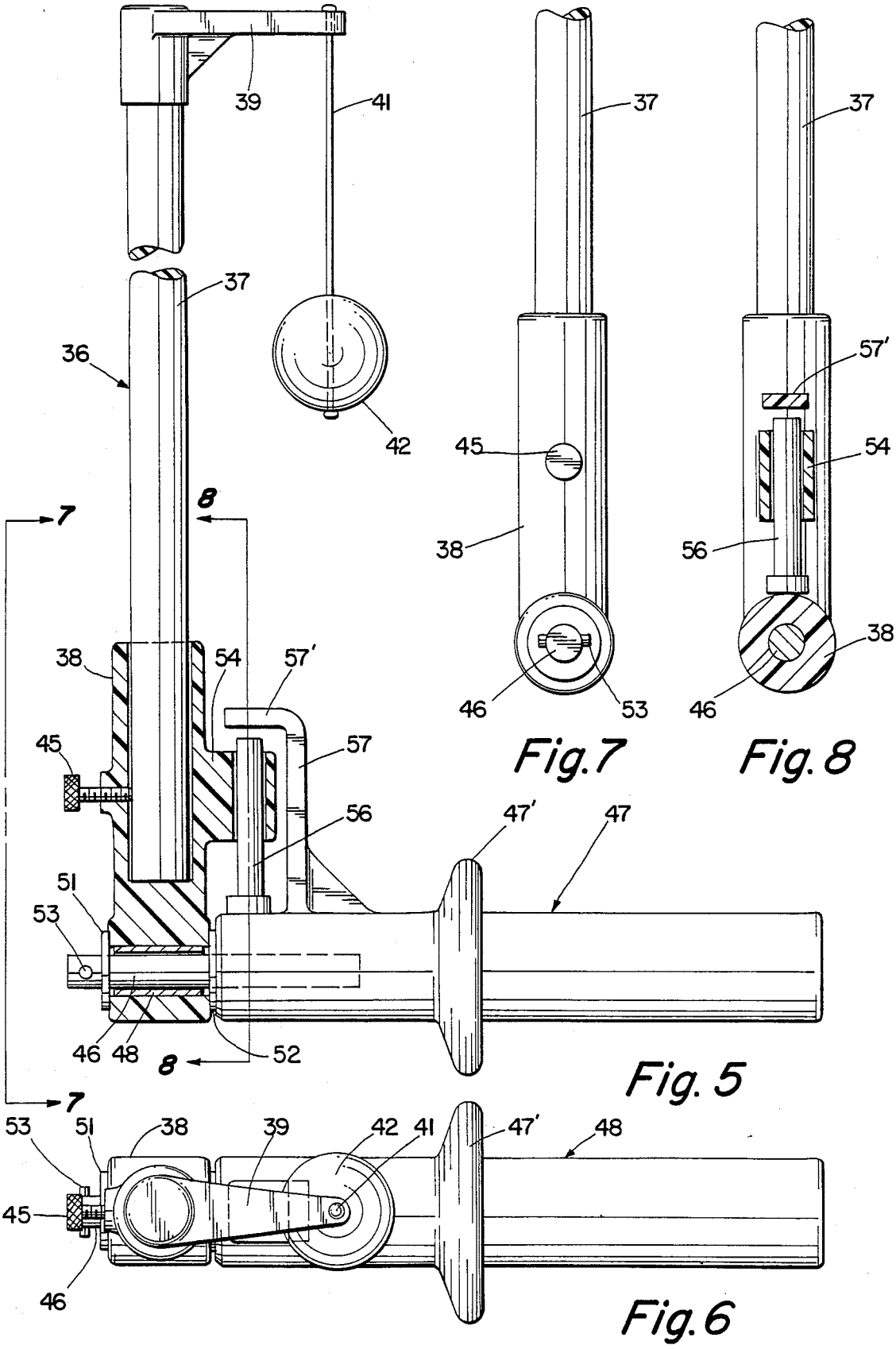
FIG. 6 is a top plan view of the full toy of FIG. 5.
FIG. 7 is a fragmentary end elevational view of the one bracket for pivotally connecting the balancing stick to the handle member as viewed from line 7—7 of FIG. 5.
FIG. 8 is a fragmentary vertical sectional view taken on line 8—8 of FIG. 5 and through the drop pin latch assembly.

The casting part 38 has a lateral extension 54 with a hole for slidable retaining headed drop latch pin 56 that drops to be engaged by a forwardly bent end 57' of a projection arm 57 extending radially outwardly from the forward end of handle member 47. The latch pin 56 drops when the stick assembly 36 has been picked up by the arm 57 and the stick assembly, being turned up to a raised balancing position and made ready for the performance of the balancing exercise by the user 33 in the manner illustrated in FIG. 1 and as above described. The latch pin 56 drops from side engagement with the bent end 57' of handle arm 57 as the stick assembly 36 is uprighted by the turning of handle member. As shown in FIG. 5, the latch pin has dropped and the toy made ready for use.

It should now be apparent that, by the use of the drop latch pin, the handle member can be used to raise the balancing stick to its raised position preparatory for the balancing performance. It should also be apparent that the balancing toy is made up of two major assemblies that can be disassembled for purposes of storage and transport. The stick assembly is easily separable from the handle assembly, and easy assembly can be made of the toy from these assemblies, upon being taken from the box. In the first form, the balancing stick is removed from the spindle extension 19 of the handle 17 and in the modified form the plain stick 37 is merely detached from its casting part 38 that can stay on the handle 47 mere release of the thumb screw 45.

While various changes may be made in the detail construction, it shall be understood that such changes shall be within the spirit and scope of the present invention as defined by the appended claims.

What is claimed is:

1. In a balancing stick toy, a handle member having a forwardly-extending pivot shaft, a weighted balancing stick member having its lower end pivotally connected to the pivot shaft to normally turn freely thereabout and releasable means carried on one of the members and engagable with the other member so that upon turning the handle about its longitudinal axis by the hand of the user the balance stick may be brought from a depending position to an upright position and is automatically releasable to carry out the balancing exercise of the stick about the handle member.

2. In a balancing stick toy as defined in claim I and said balancing stick having a laterally-extending bracket at the upper end and a weight suspended from the outer end of the lateral bracket by a flexible connection to swing freely therefrom.

3. In a balancing stick toy as defined in claims 1 or 2 and said releasable stick means including a gravity-operated latch pin slidable in the balancing stick member, a radially-extending projection arm on the handle member engagable with the latch pin to lift the stick member and effective automatically to permit release of the latch pin under gravity and of the balance stick member from the handle member upon the stick member being turned from its depending position by the handle member and upon arriving at its upright balancing position.

4. In a balancing stick toy as defined in claim 3 and said radially-extending projection arm having a forwardly bent end engagable with the latch pin said slidable gravity-operable latch pin being headed to prevent its displacement from the stick member, in its depending position, said latch pin on dropping when the stick is in the upright position engagable with surface of the handle member to prevent its displacement from the stick member.

5. In a balancing stick toy as defined in claim 3 and said balancing stick member being in the form of an assembly of a bracket and the gravity-operated release pin being detachably slide fitted into the bracket and releasably retained therein for disassembly and transport.

* * * * *